United States Patent [19]

Kadnar

[11] Patent Number: 4,756,125

[45] Date of Patent: Jul. 12, 1988

[54] SKATE BLADE SHARPENING DEVICE

[76] Inventor: Frank W. Kadnar, 1550 Kirkland Pl/Dorval, Quebec, Canada, H9S 1C9

[21] Appl. No.: 9,745

[22] Filed: Feb. 2, 1987

[51] Int. Cl.[4] ..... B24B 9/04

[52] U.S. Cl. ..... 51/102; 51/168; 51/285

[58] Field of Search ..... 51/74 R, 74 BS, 92 R, 51/92 BS, 98 BS, 100 R, 102, 168, 285

[56] References Cited

U.S. PATENT DOCUMENTS

| | | | |
|---|---|---|---|
| 1,162,970 | 12/1915 | Binford | 51/168 |
| 2,486,850 | 11/1949 | Ives | 51/102 |
| 2,563,018 | 8/1951 | Fello | 51/102 |
| 3,719,006 | 3/1973 | Vezeau | 51/102 X |
| 3,881,280 | 5/1975 | Thompson | 51/102 |

*Primary Examiner*—Robert P. Olszewski
*Attorney, Agent, or Firm*—Roland L. Morneau

[57] ABSTRACT

A self-contained skate blade sharpening device, comprises a base plate on which is mounted a box and a housing adjacent to the box. An electric motor in the box and the shaft of the motor, which extends outside the box drivingly supports a grinding wheel. The motor is spring mounted on a hinged plate so that the grinding wheel is resiliently biassed upwardly. A guide member having a groove to receive the skate blade is removably located above the grinding wheel in a slot between the box and the housing parallel to the plane of the grinding wheel. An aperture is provided in the bottom if the groove above the wheel and tangential to the wheel. The periphery of the grinding wheel has a convex cross-section. The skate blade is sharpened by sliding it in the groove while the motor is rotating. The particular resilient action of the grinding wheel and its combination with the guiding member provide a smooth and adjustable sharpening result.

1 Claim, 2 Drawing Sheets

SKATE BLADE SHARPENING DEVICE

FIELD OF THE INVENTION

This invention relates to a self-contained skate blade sharpening device.

DESCRIPTION OF THE PRIOR ART

Self-contained devices for sharpening skate blades are described in U.S. Pat. No. 2,563,018 to J. Fellow issued on Aug. 7, 1951 and in Canadian Pat. No. 1,013,945 to A. Thompson issued on July 19, 1977. In both of these patents, the blade is sharpened in a position perpendicular to the plane of the grinding wheel. The periphery of the grinding wheel is flat across its width. In addition, the motor is rigidly secured to a base plate which does not permit the grinding wheel to give in slightly upon a downward pressure applied on the wheel.

BRIEF SUMMARY OF THE INVENTION

The present skate blade sharpening device is self-contained, simple, easy to operate and makes it possible to adopted the results to the idiosyncrasies of the skaters.

The device comprises a box containing a motor hingely mounted and a grinding wheel removably secured to a shaft extending from the motor outside the box. A housing covering the grinding wheel is fixed adjacent the box to leave a slot between the top of the box and housing and over the plane of the grinding plane. A guiding member adapted to receive the skate blade is positionned in the slot at an adjustable height so that an upper segment of the wheel protrude slightly through an opening cut through the bottom of the guide member. When the grinding wheel is rotated by the motor, the skate is slidden in the guide member from one end of the blade to the other.

DETAILED DESCRIPTION OF THE PREFERRED EMBODIMENT

Figure 2:
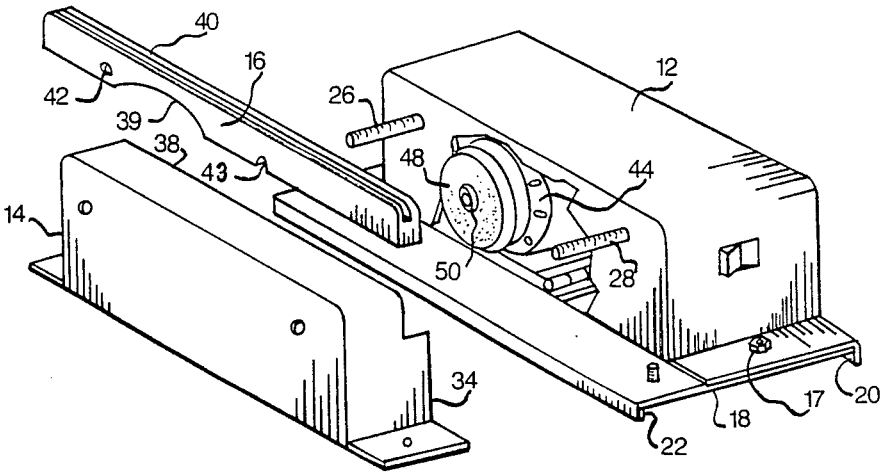
FIG. 2 is an exploded view of the device as shown in FIG. 1 with the housing and the guide member separated from the box, the latter having a cut-out showing the motor.
Figure 1:
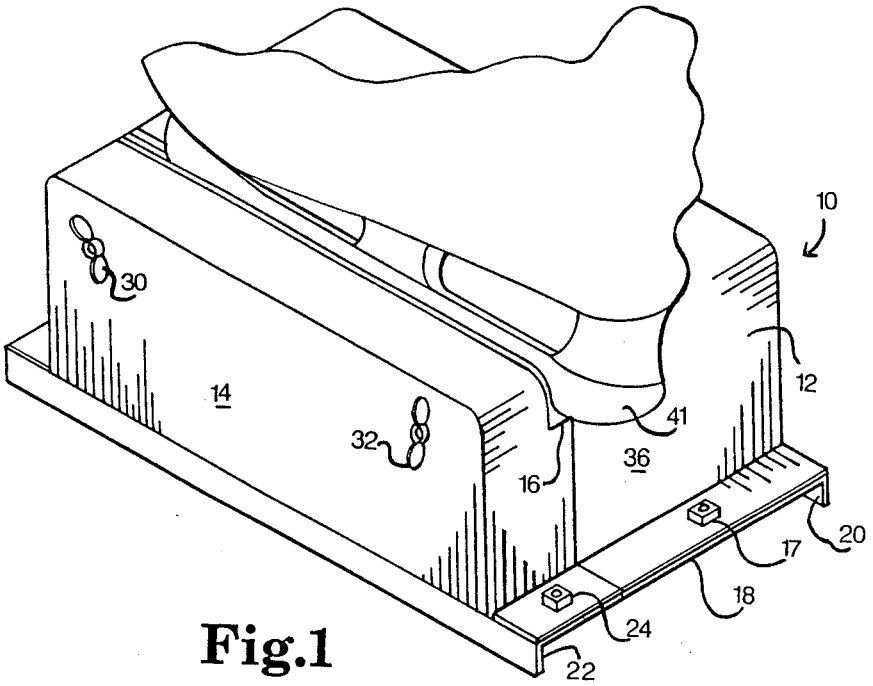
FIG. 1 is a perspective view of the skate blade sharpening device according to invention with a skate partly illustrated in its operating position.

The skate blade sharpening device 10 as illustrated in FIGS. 1 and 2 comprises an elongated box 12, a housing 14 and a guide member 16. The box 12 is fixed with bolts and nuts 17 to a supporting plate 18 having flanges 20 and 22. The housing 14 is also fixed to the plate 18 with bolts and nuts 24. The housing 14 is retained positively against the box 12 by threaded rods rigidly secured to the box 12 and extending outwardly of the box. The rods 26 and 28 are long enough to protrude through the housing 14 when the latter is mounted on the plate 18. The housing 14 is held firmly against the box 12 by wing nuts 30 and 32. The housing is hollow and the side edges 34 abut against the sidewalls 36 of the box. A strip of the upper edge 38 of the housing is cut so as to leave a longitudinal slot between the housing 14 and the box 12.

A guide member 16 dimensioned to fit into the slot is supported by the rods 26 and 28. The guide member is provided at one end with a hole 42 for engaging rod 26 and at the other end with a notch 43 for sitting over the rod 28. The guide member 16 is accordingly adapted to pivot upwardly around the rod 26 so as to free the slot and allow visual access inside the housing.

The guide member 16 has a groove 40 with parallel walls in its upper surface for allowing the sliding of the skate blade 41 therethrough. The lower edge of the member 16 has a large curved indentation 39 in line with the upper periphery of the wheel 48 to prevent any friction between the wheel 48 and the member 16.

The bottom of the groove 40 is perforated right above the indentation 39 and the level of the member 16 is positioned so that the upper segment of the grinding wheel 48 is about tangential with the bottom of the groove 40.

Inside the box 12 is mounted an electric motor 44. The motor shaft 46 extends outside the box 12 and supports the grinding wheel 48 which is removably secured on the shaft 46 by a nut 50. The shaft 46 as a D-shaped cross-section and the hole in the center of the grinding wheel 48 as a corresponding cross-section to prevent the slipping of the wheel on the shaft. This rotational locking of the wheel on the shaft is needed when the wheel must be changed. In order to unfastened the nut 46, it is possible to hold the wheel 48 with one hand while the other hand holds a key which untightens the nut 46. The cylindrical portion of the shaft is threaded in a direction opposite the direction of rotation of the motor to maintain the nut 50 firmly engaged on the shaft during rotation.

Figure 3:
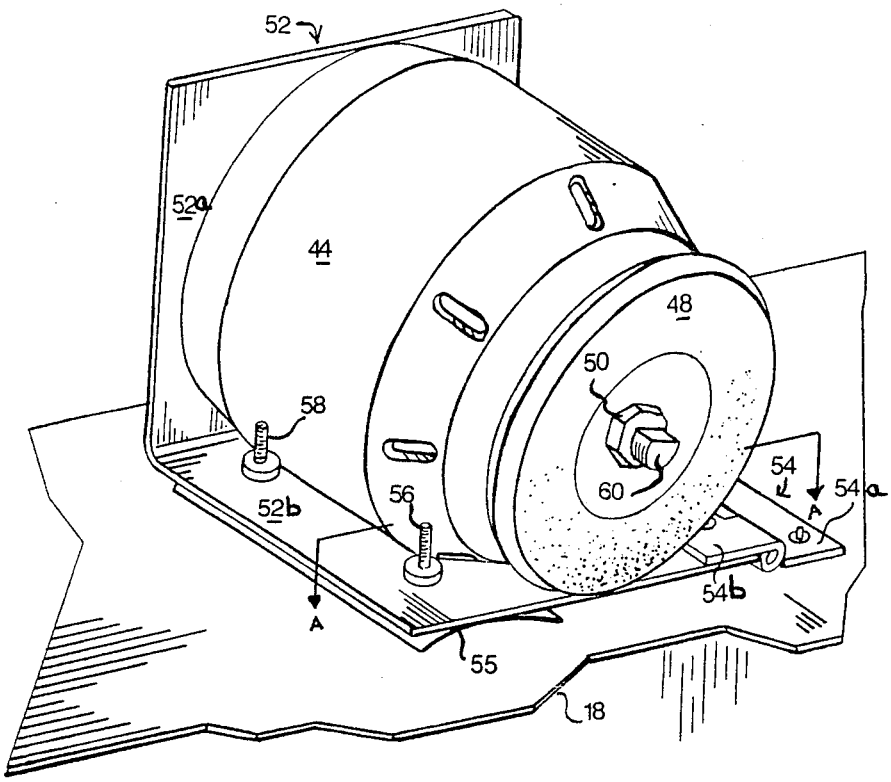
FIG. 3 is a perspective view of the adjustable mounting arrangement for the motor.
Figure 4:
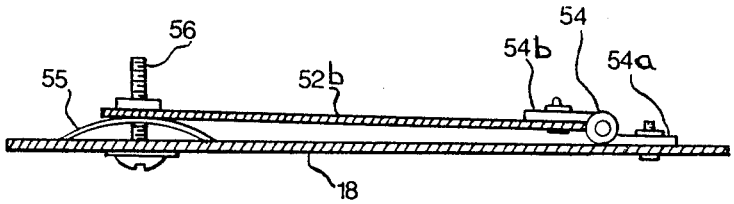
FIG. 4 is a cross-section view of the supporting elements of the motor along the plane A—A of FIG. 3.

FIG. 3 shows the motor 44 rigidly mounted on the angular bracket 52. The bracket forms a perpendicular angle comprising a vertical portion **52*a* and a horizontal portion 52*b*. The rear of the motor is bolted on the vertical portion 52*a* and the bottom of the motor is spaced from the horizontal portion 52*b*. The angular bracket 52 is made with such a flexibility so as to allow the wheel 58 to slightly move vertically when a downward pressure is applyied to the wheel. The horizontal portion 52*b* is hinged to the plate 18 by a hinge 54. The portion 54*b* is bolted to the right-hand ledge of the horizontal portion 52*b* and the other portion 54*a* of the hinge is bolted to the base plate. The left-hand ledge of the portion 52*b* is spaced from the plate 18 by an arched leaf spring 55 and both the portion 52*b* and the plate 18 are adjustably spaced by turning screws 56 and 58. The heads of both screw 56 and 58 protrude on the bottom of the plate 18 and a screw driver is used to turn them and accordingly compress the spring 55 and vary the height of the grinding wheel 48**.

Into the mounting arrangement of the motor shown in FIG. 3, the grinding wheel displays resiliency along two orthogonal vertical planes i.e. one parallel to the axis of the motor shaft 46 and the other perpendicular of that shaft. This resiliency is used when the skate blade is put in contact with the grinding wheel 48. It provides a soft touch and a smooth grinding effect on the blade.

This device is simple in construction and easy to operate. It is particularly intended for individual use and accordingly can be adapted to different skaters and skating conditions.

Although, the majority of the skaters will carefully align the grinding wheel 48 and the groove 40 of the guiding member 16, some may prefer a groove 46 which is slightly off center with the wheel 48 or slightly inclined in relation thereto. Such arrangements are possible with a grinding wheel having the proposed resiliency and may be contemplated by speed skaters who are always rotating in the same direction or other skaters who are predominantly moving in specific directions.

The guide member 16 is usually made of PVC plastic and is provided in sets of two. One member of the set as a groove of a width adapted for hockey skates and another with a different width for figure skaters. The present device makes the substitution of the guide members easy because it is sufficient to remove the wing nuts 30 and 32, the bolts 34 and housing 14.

The facility and the speed with which the grinding wheel can be removed and replaced is important because it is not changed only when the wheel becomes worn out but also when one wants to subtitute a wheel of a different grit such as 60 or 80 or of a different convexity on its periphery. The present sharpening device is intended for individuals having professional requirements. It is therefore expected that the guiding member 16 and the grinding wheel 48 can be changed depending on the skate blade, the skaters, the skating conditions and the performance desired.

In actual operation, when the correct grinding wheel and the appropriate guide member are mounted, the height of the grinding wheel is adjusted by rotating the screws 46 and 48. The desired height is reached when the wheel 48 barely touches the blade 41 as shown in FIG. 1. The feel of contact with the wheel is particularly noticed when the blade glides in the groove.

The motor is then actuated and the skate is pushed gently to make the blade glide in the groove 40. The skate should preferably move in the direction opposite the tangential movement of the wheel. This gliding movement is repeated until the edges of the skate blade reach the desired sharpness. The movement of the skate in this direction creates the fastess linear speed of the wheel on the blade. However, a final stroke in the opposite direction gives the blade a smoother finish.

I claim:

1. A self-contained skate blade sharpening device comprising:

(a) a closed elongated box, a motor disposed over a bottom surface of said box, said motor having a rotatable axial shaft extending through one side of said box;

(b) a grinding wheel removably mounted on said shaft and rotatably fixed thereon and a removable locking means for maintaining said wheel on a plane on said shaft outside said box;

(c) a housing adapted to cover the said one side of the box and means to removably secure said housing to said box, the top of said housing being slightly spaced from the said box so as to leave a slot between the housing and the box and over said plane of the wheel;

(d) a longitudinal guide member fixed in said slot having a groove in its upper surface with parallel walls corresponding to the width of the skating blade, the said groove being aligned with said plane of the said grinding wheel and being provided with an opening in its bottom surface for permitting an upper segment of the wheel to slightly protrude in said groove;

(e) means for adjusting the distance between the grinding wheel and the guide member so as to vary the protrusion of the said upper segment of the wheel in said groove, the said adjusting means comprising an angular bracket having a vertical and a horizontal portion, the said motor being fixed to said vertical portion, threaded means mounted between said bottom of the box and said horizontal portion for vertically moving the said wheel, the said bottom of the box being hingely mounted to said horizontal portion along an axis parallel to the shaft of the motor, spring means mounted between said horizontal portion and said bottom of the box for resiliently biassing the horizontal portion upwardly, the said threaded means adapted to raise the said wheel to a predetermined upper level, (f) the said means for removably securing said housing to said box comprising a supporting plate extending below said box and said housing and fixed thereon, a pair of rods secured to the box and extending freely through said housing, both said rods being located at a level substantially corresponding to the upper periphery of the wheel and spaced on each side of said wheel, said rods being adapted to support the guide member, said guide member being pivotally fixed at one end to one of the said rods and being removably hooked on the other rods so as to permit visual observation of the grinding wheel through the said slot when the guide member is pivotally lifted around the said first rod, the outer edge of the wheel having a convex cross-section, to form a concave groove in the bottom of the skate blade.

* * * * *